US009788615B2

(12) United States Patent
Kojima

(10) Patent No.: US 9,788,615 B2
(45) Date of Patent: Oct. 17, 2017

(54) FASTENER STRINGER

(71) Applicant: YKK Corporation, Tokyo (JP)

(72) Inventor: Masayoshi Kojima, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/113,905

(22) PCT Filed: Feb. 17, 2014

(86) PCT No.: PCT/JP2014/053651
§ 371 (c)(1),
(2) Date: Jul. 25, 2016

(87) PCT Pub. No.: WO2015/122018
PCT Pub. Date: Aug. 20, 2015

(65) Prior Publication Data

US 2016/0338453 A1 Nov. 24, 2016

(51) Int. Cl.
*A44B 19/06* (2006.01)

(52) U.S. Cl.
CPC ..... *A44B 19/06* (2013.01); *Y10T 24/255* (2015.01); *Y10T 24/2539* (2015.01)

(58) Field of Classification Search
CPC ..... A44B 19/06; A44B 19/02; A44B 19/04; A44B 19/18; Y10T 24/02539; Y10T 24/255; Y10T 24/2552; Y10T 24/2554; Y10T 24/2555; Y10T 24/2557; Y10T 24/2559; Y10T 24/2539
See application file for complete search history.

(56) References Cited

U.S. PATENT DOCUMENTS 5,713,110 A * 2/1998 Covi ..... A44B 19/08 24/405
2014/0013548 A1* 1/2014 Takani ..... A44B 19/06 24/387

FOREIGN PATENT DOCUMENTS

| | | | |
|---|---|---|---|
| EP | 1388302 | A1 | 2/2004 |
| JP | 59-101104 | A | 6/1984 |
| JP | 2007-021023 | A | 2/2007 |
| JP | 1434591 | S | 2/2012 |

(Continued)

OTHER PUBLICATIONS

International Search Report, PCT International Application No. PCT/JP2014/053651, dated Apr. 28, 2014.

(Continued)

*Primary Examiner* — Abigail Troy
(74) *Attorney, Agent, or Firm* — Kilpatrick Townsend & Stockton LLP

(57) ABSTRACT

These fastener elements have: an element main body portion having a coupling head portion; and first and second projections that project in a tape surface/rear-surface direction from the element main body portion. The first and second projections have a top surface, peripheral side surfaces standing upright from the element main body portion, and at least one sloped surface between the top surface and the peripheral side surfaces that has a different angle of inclination from the top surface and the peripheral side surfaces. As a result, the fastener elements appear long and narrow in the element length direction and have an external appearance close to that of a metal element. Furthermore, a stop claw portion is less likely to catch on the fastener elements when starting the sliding operation of a slider.

9 Claims, 10 Drawing Sheets

(56) References Cited

FOREIGN PATENT DOCUMENTS

| | | | |
|---|---|---|---|
| JP | 1434592 | S | 2/2012 |
| JP | 1434827 | S | 2/2012 |
| WO | 2010/082294 | A1 | 7/2010 |
| WO | 2013/051149 | A1 | 4/2013 |

OTHER PUBLICATIONS

JP Office Action, Patent Application No. 2015-562681 dated May 31, 2017.

* cited by examiner

FASTENER STRINGER

This application is a national stage application of PCT/JP2014/053651, which is incorporated herein by reference.

TECHNICAL FIELD

The invention relates to a fastener stringer in which a plurality of fastener elements made of synthetic resin are arranged by injection molding in a tape side edge portion of a fastener tape. In particular, the invention relates to a fastener stringer in which each fastener element made of synthetic resin has an appearance like a metallic fastener element.

BACKGROUND ART

As a fastener element which is conventionally used for a slide fastener, a fastener element made of synthetic resin which is formed individually by injection-molding synthetic resin onto a fastener tape, a continuous fastener element which is formed by molding a mono-filament in a coiled shape or a zigzag shape, and a metallic fastener element which is formed by caulking an approximately Y-shaped metallic element material onto a fastener tape, and the like are known.

Further, in general, the fastener element made of synthetic resin is directly fixed to the fastener tape when injection molding. Therefore, by broadening a fixing area of the fastener element with respect to the fastener tape, fixing strength of the fastener element with respect to the fastener tape can be enhanced. For this reason, in a conventional fastener element made of synthetic resin, an element width dimension of each fastener element has been set large in order to ensure the fixing strength of the fastener element stably.

Whereas, since the metallic fastener element is attached to the fastener tape, for example by caulking an element which has an approximately-Y-shaped cross section, the metallic fastener element can easily obtain enough fixing strength without setting the element width dimension as large as in the fastener element made of synthetic resin as described above.

Also, for example, WO 2010-082294 A (Patent Document 1) and WO 2013-051149 A (Patent Document 2) disclose fastener stringers in which the appearance quality of the fastener element is enhanced. Those fastener elements are formed with lighter synthetic resin compared to a metal and have an appearance (show) like a metallic fastener element.

For example, the fastener element of the fastener stringer described in Patent Document 1 is attached to a tape side edge portion of a fastener tape by injection-molding thermoplastic resin. Each of the fastener elements has a first half portion disposed on the tape upper surface side of the fastener tape and a second half portion disposed on the tape lower surface side and formed integrally with the first half portion.

Further, here, an upper and lower direction refers to a tape front and back direction which is orthogonal to a tape surface of the fastener tape. Also, a top and bottom direction refers to a length direction of the fastener tape, and a left and right direction refers to a tape width direction of the fastener tape.

In this fastener element of Patent Document 1, the first half portion includes a fixing portion fixed to the fastener tape and an extending portion extending tape outward direction from the fixing portion. The extending portion has a tapering shape in which an element width dimension in a tape length direction gradually decreases toward a tip end portion of the extending portion.

Further, in the first half portion, in order to ensure the fixing strength with the fastener tape, the element width dimension in a lower end portion (end portion on a side which is in contact with the fastener tape) of the fixing portion has a predetermined size. In addition, a top side surface and a bottom side surface of the fixing portion in the first half portion are formed as a convex surface, which curves outward in a convex shape such that the element width dimension (longitudinal direction) of the first half portion gradually decreases from a tape surface of the fastener tape toward an upper surface of the fastener element.

The second half portion includes a body portion fixed to the fastener tape, a neck portion extending tape outward direction from the body portion and is constricted so as to decrease the dimension in the element width direction, and an coupling head portion extending further tape outward direction from the neck portion. Therefore, each fastener element in Patent Document 1 is coupled with a fastener element of a coupling counterpart on the side of the second half portion.

Since such a fastener element in Patent Document 1 is made of synthetic resin, it is light in weight compared to a metallic fastener element. Additionally, the fastener element is formed so as to appear thinner than a conventional fastener element made of synthetic resin by forming a convex surface on the first half portion, while ensuring fixing strength with the fastener tape, so that the fastener element has an appearance (show) like a metallic fastener element.

Therefore, a slide fastener to which the fastener elements in Patent Document 1 are attached looks stylish or adds a fashionable impression like a slide fastener in which metallic fastener elements are attached (simply mentioned "metal slide fastener" thereafter) and at the same time is significantly reduced in weight compared to a metal slide fastener.

However, for example, in a case that a slide fastener is formed using fastener stringers according to Patent Document 1 and a slider with a stopping mechanism having a stop claw portion which is capable of being engaged to a fastener element, the engagement of the stop claw portion in the slider of the fastener stringer in Patent Document 1 with the fastener element can be easily unstable since a convex surface is formed on the first half portion of the fastener element.

Furthermore, in the faster elements described in Patent Document 1, a shape of the first half portion formed on the tape upper surface side and a shape of the second half portion formed on the tape lower surface side differ from each other. Therefore, for example, in a slide fastener having fastener stringers described in Patent Document 1 and a separable bottom end stop, in a case that a so-called slide fastener for right-side insertion, in which an insert pin is inserted into a box from the right side of a box pin, and a so-called slide fastener for left-side insertion, in which the insert pin is inserted into the box from the left side of the box pin, are manufactured, dedicated dies for right-side insertion and for left-side insertion are required, respectively. This is one of the factors causing manufacturing cost increase of the slide fastener.

Meanwhile, Patent Document 2 discloses a fastener stringer in which a fastener element made of synthetic resin including a first half portion disposed on a tape upper surface side of a fastener tape, a second half portion disposed on a tape lower surface side of the fastener tape, and an element coupling portion disposed between the first and the second half portions.

In the fastener elements described in Patent Document 2, the first half portion (upper half portion) and the second half portion (lower half portion) have a plane-symmetrical shape each other about a center position in a tape front and back direction of the fastener tape. Therefore, here, the first half portion is described in detail, so that the detailed description of the second half portion is omitted.

The first half portion described in Patent Document 2 includes a first fixing portion fixed to the fastener tape and a first extending portion extending tape outward direction from the first fixing portion. The first extending portion has a tapered element shape in which an element width dimension gradually decreases toward a tip end portion. Further, atop side surface and a bottom side surface in the first half portion are formed to be a curved surface (concave surface), respectively, which curves in a concave shape such that the element width dimension gradually increases from an upper surface of the fastener element toward an upper tape surface of the fastener tape.

In the fastener elements described in Patent Document 2, the top side surface and the bottom side surface in the first half portion are formed as the concave surface respectively. Therefore, when the fastener element is viewed from an upper surface side, the top side surface and the bottom side surface in the first half portion can hardly be seen in comparison with a case that each of the side surfaces is formed in a convex shape, for example. In addition, reflecting light on the top side surface and the bottom side surface becomes hard to scatter toward upper side of the fastener element, so that a visual effect that the side surface on the top and the side surface on the bottom become to be shadow parts and appear dark, can be obtained.

Thus, in the fastener elements described in Patent Document 2, the first and the second half portions appear to be narrow in the element width direction and thin in an element length direction, so that it is possible to exhibit an appearance (show) closer to a metallic fastener element.

Further, in a case that a slide fastener is formed using fastener stringers according to Patent Document 2 and a slider with a stopping mechanism by a stop claw portion, since the top side surface and the bottom side surface in the first half portion of the fastener element are formed to be the concave surface in the fastener stringer of Patent Document 2, it is possible that the stop claw portion of the slider can be received and accommodated securely on the top side surface and the bottom side surface. Thereby, the engagement of the stop claw portion with respect to the fastener elements can be secured.

Furthermore, since the fastener elements described in Patent Document 2 have a plane-symmetrical shape about the center position in the tape front and back direction of the fastener tape, it is possible to be used for a slide fastener with right-side insertion and also with left-side insertion without altering the shape. Thereby, it can reduce the cost for molding dies for elements and the manufacturing cost reduction of the slide fastener can be achieved.

On the other hand, in Design Registration No. 1434591 (Patent Document 3), a fastener chain for slide fastener, in which fastener elements having substantially the same shape as those in Patent Document 2 are attached to a fastener tape, is illustrated.

Additionally, for example, in Design Registration No. 1434827 (Patent Document 4), a fastener chain for slide fastener which design is further improved by providing more irregularities on an upper surface of the fastener elements illustrated in Patent Document 2, is illustrated.

CITATION LIST

Patent Documents

Patent Document 1: WO 2010-082294 A
Patent Document 2: WO 2013-051149 A
Patent Document 3: Design Registration No. 1434591
Patent Document 4: Design Registration No. 1434827

SUMMARY OF THE INVENTION

Problems to be Solved by the Invention

A slide fastener which is similar to a metal slide fastener and is light weight compared to a metal slide fastener can be formed by showing the fastener elements shown in Patent Documents 1 to 4 like metallic fastener elements as described above.

However, although the appearance of these fastener elements is similar to that of metallic fastener elements, they are different from metallic fastener elements when they are compared with metallic fastener elements. Therefore, it has been required to make an appearance of fastener elements made of synthetic resin further closer to that of metallic fastener elements by such as showing it longer in the element length direction (tape width direction) while ensuring fixing strength of the fastener elements.

Further, in the fastener stringer of Patent Document 2, since the top side surface and the bottom side surface in the first half portion of the fastener element are formed as the concave surface, in the case that the slide fastener is formed using the slider with the stopping mechanism as mentioned above, it is possible that the stop claw portion of the slider is received securely on the top side surface and the bottom side surface of the fastener elements. Thereby, the engagement of the stop claw portion with respect to the fastener elements can be secured.

On the other hand, in a slide fastener with a slider having a stopping mechanism, in a case that the slider is operated and slid along element rows from a state that a stopping state of the slider is maintained such that the stop claw portion of the slider is engaged with the fastener elements, generally, a pull tab of the slider is pulled by a user. Thereby, the stop claw portion is lifted up by the pull tab and the engagement with the fastener elements is released, so that it becomes possible to slide the slider. Especially in this case, the stop claw portion of the slider is lifted up to a sufficient height by the pull tab, so that the slider can be slid smoothly without being caught in the fastener elements.

Furthermore, in a product in which a slide fastener is actually used, when a sliding operation is started by pulling a pull tab of a slider, the slider sometimes starts sliding before a stop claw portion is lifted up by the pull tab sufficiently. At this moment, the stop claw portion of the slider will be lifted upward while being slidably in contact with a top side surface or a bottom side surface of fastener elements.

However, in the fastener stringer of Patent Document 2, since the top side surface and the bottom side surface in the first half portion of the fastener element are formed as the concave surface, the stop claw portion is lifted upward while being slidably in contact with the top side surface and the bottom side surface in the first half portion, when the slider starts sliding before the stop claw portion is lifted up sufficiently by the pull tab upon the start of the sliding operation of the slider. However, it might be caused that the stop claw portion is easily caught on an upper end portion of the concaved top side surface or the bottom side surface.

In the case that the stop claw portion is caught on the upper end portion of the top side surface or the bottom side surface in the first half portion upon the start of the sliding operation of the slider in this way, it prevents the slider from sliding smoothly or it stops the slider, so that it leads to the deterioration of an operational property of the slider. Also when the stop claw portion is caught momentarily on the fastener element upon the start of the sliding operation of the slider, the user who operates the slider tends to slide the slider by force by pulling the pull tab of the slider strongly. Thereby, it might be caused that the stopping mechanism of the slider is not functioned due to damage of the stop claw portion and that life of the slide fastener shortens since the stop claw portion damages the fastener element in which the stop claw portion is being caught. Furthermore, some users pull the attached body itself in order to open the slide fastener by force without using the pull tab. Thereby, it might be caused that the stop claw in a locked state damages the fastener element.

The invention has been made in view of the conventional problems described above. The specific object of the invention is to provide a fastener stringer having fastener elements made of synthetic resin which make it possible to show thin in an element length direction or which have an appearance closer to metallic fastener elements, additionally, in which a stopping mechanism can be worked stably and a stop claw portion cannot be easily caught upon the start of sliding operation of the slider, even in a case that a slider comprises a stopping mechanism by the stop claw portion.

Means for Solving the Problems

In order to achieve the above object, a fastener stringer provided by the invention includes a fastener tape and a plurality of fastener elements made of synthetic resin attached to a tape side edge portion of the fastener tape as a basic configuration, in which the fastener element includes an element main body portion fixed so as to extend across a first tape surface and a second tape surface of the fastener tape, and first and second projections projected in a tape front and back direction from the element main body portion, and in which the element main body portion has a body portion fixed to the fastener tape, a neck portion in a constricted shape extending tape outward direction from the body portion and a coupling head portion in an elliptical shape extending from the neck portion, and the fastener stringer is most mainly characterized in that an outer surface of the first projection and an outer surface of the second projection respectively have at least one top surface parallel to the first tape surface and the second tape surface of the fastener tape, a peripheral side surface rising from the element main body portion and at least one sloped surface which is between the top surface and the peripheral side surface and has a different inclination angle with respect to the top surface and the peripheral side surface.

In the fastener stringer according to the invention, it is preferable that the first projection includes an element base disposed on the body portion and an element tip end portion extending from the element base toward the coupling head portion side in a tape width direction, and has a tapered shape in which a dimension in a tape length direction gradually decreases toward the tip end, and that the element tip end portion of the first projection has an intermediate sloped surface which slopes upward from the peripheral side surface to a top portion so as to have a smaller inclination angle with respect to the first tape surface of the fastener tape than that of the peripheral side surface.

In this case, it is preferable that the intermediate sloped surface of the element tip end portion is formed as a flat surface. It is also preferable that the peripheral side surface of the element tip end portion is formed as a curved surface which curves in a concave shape or a flat surface from the element main body portion to the intermediate sloped surface.

Further, it is preferable that the element base includes an intermediate sloped surface which slopes upward from the peripheral side surface to the top surface so as to have a smaller inclination angle with respect to the first tape surface of the fastener tape than that of the peripheral side surface, and that the intermediate sloped surface of the element tip end portion and the intermediate sloped surface of the element base are formed as a single continuous surface. In this case, it is particularly preferable that the intermediate sloped surface of the element tip end portion is disposed so as to extend toward the coupling head portion side beyond the most constricted part of the neck portion of the element main body portion in the tape width direction.

Further, in this case, it is particularly preferable that a first ridge line portion formed between the peripheral side surface and the intermediate sloped surface of the element base is disposed on an outer position than the most constricted part of the neck portion in the tape length direction, and a second ridge line portion formed between the intermediate sloped surface and the top surface of the element base is disposed on an inner position than the most constricted part of the neck portion in the tape length direction.

Further, in the fastener stringer according to the invention, it is preferable that a maximum dimension in the tape front and back direction from the element main body portion to the top portion in the element tip end portion of the first projection is set to be larger than a half size of the maximum dimension in the tape front and back direction of the element main body portion.

And further, it is preferable that the second projection has a plane-symmetrical shape with respect to the first projection about a center position in the tape front and back direction of the fastener tape.

Advantageous Effects of Invention

In the fastener stringer according to the invention, each of the fastener elements made of synthetic resin is fixed so as to extend across the first tape surface and the second tape surface of the fastener tape, and includes the element main body portion having the body portion, the neck portion and the coupling head portion and the first and the second projections which project from the first surface and the second surface of the element main body portion.

Further, the outer surface of the first projection and the outer surface of the second projection in the fastener element include at least one top surface, the peripheral side surface which rises from the element main body portion, and at least one sloped surface which is between the top surface and the peripheral side surface and has a different inclination angle with respect to the top surface and the peripheral side surface. Here, the sloped surface means a surface of a region portioned with other surfaces such as a top surface and a peripheral side surface via a ridge line portion, and includes a curved surface which curves in a concave shape and a curved surface which curves in a convex shape as well as a flat surface.

In the present invention, since the outer surface of the first projection and the outer surface of the second projection in the fastener element are formed of a plurality of the surfaces as described above, when the fastener element is viewed from the upper surface side or the lower surface side, the first and the second projections can be appeared thinner in the element length direction with respect to the fixing region of the element main body portion fixed to the first tape surface and the second tape surface. As another effect, it becomes possible to reflect light with each of the surfaces of the fastener element, so that it is possible to provide the fastener element with a gloss like a metal. Therefore, the fastener element made of synthetic resin in the present invention can exhibit a closer appearance (show) to the metallic fastener element.

Further, in the fastener stringer according to the present invention, since each of the fastener elements has a tapered shape on the front and back surfaces of the element main body portion as described above, or the first and the second projections having a gloss like a metal, it becomes possible to be used for a so-called slide fastener with right-side insertion and also with left-side insertion. Therefore, it is possible to reduce the cost for molding dies for element and to obtain a manufacturing cost reduction of the slide fastener.

In such a fastener stringer according to the present invention, the first projection of the fastener element includes the element base disposed on the body portion and the element tip end portion extending from the element base toward the coupling head portion side in the tape width direction and has the tapered shape in which the dimension in the tape length direction gradually decreases toward the tip end. Further, the element tip end portion of the first projection has the intermediate sloped surface which slopes upward from the peripheral side surface to the top portion including the top surface so as to have a smaller inclination angle with respect to the first tape surface of the fastener tape than that of the peripheral side surface.

Accordingly, it is possible to provide a fastener element which can be appeared thinner in the element length direction than the actual element fixing region with respect to the fastener tape as described above. Further, it is possible to provide the outer surface of the first projection with a gloss like a metal as described above. In addition, for example, in a case that a slide fastener is formed using a slider with a stopping mechanism in which a stop claw portion is disposed so as to correspond to an element tip end portion of a fastener element, it is possible to receive the stop claw portion of the slider on the peripheral side surface of the first projection in the fastener element and to secure the engagement of the stop claw portion with respect to the fastener element.

Further, since the intermediate sloped surface as described above is disposed between the peripheral side surface and the top surface of the element tip end portion, when the sliding operation of the slider is stared, it is possible to lift upward the stop claw portion engaged with the fastener element smoothly while being slidably in contact with the intermediate sloped surface which slopes more moderately than the peripheral side surface continuously from the peripheral side surface of the first projection.

Thereby, the stop claw portion is hardly caught in the fastener element (especially the first projection) when the sliding operation of the slider is started, so that it can prevent the operability of the slider from decreasing. Therefore, the user does not slide the slider by force by pulling the pull tab of the slider strongly, and it can prevent a breakage of the stop claw portion and a breakage of the fastener element due to the catch of the stop claw portion with respect to the fastener element.

Further, with a presence of such an intermediate sloped surface, for example, even in a case that a height dimension of the element tip end portion is set to be larger, the strength of the first projection can be enhanced by securing the dimension between the peripheral side surface on the top side and the peripheral side surface on the bottom side in the element tip end portion comparatively larger. Thus, such as when the stop claw portion of the slider engages with the first projection, it becomes possible that the problem such as a chip-off or break-off of the first projection hardly occur.

In this case, since the intermediate sloped surface of the element tip end portion is disposed as the flat surface, it is possible to reflect light effectively on the intermediate sloped surface. Therefore, it becomes possible that the fastener element appears to be thin and the outer surface of the first projection has a gloss like a metal stably. Further, when the sliding operation of the slider is started, it is possible to lift the stop claw portion of the slider upward smoothly while being slidably in contact with the intermediate sloped surface stably.

Further in this case, since the peripheral side surface of the element tip end portion is formed as the curved surface which curves in a concave shape from the element main body portion to the intermediate sloped surface, it is possible to receive securely the stop claw portion of the slider on the peripheral side surface of the element tip end portion and to secure the engagement of the stop claw portion with respect to the fastener element. On the other hand, since the peripheral side surface of the element tip end portion is formed as the flat surface from the element main body portion to the intermediate sloped surface, when the sliding operation of the slider is started, the stop claw portion of the slider can hardly be caught in the peripheral side surface, and can be lifted upward smoothly while sliding in contact with the peripheral side surface and the intermediate sloped surface stably.

In the invention, the element base of the first projection includes the intermediate sloped surface which slopes upward from the peripheral side surface to the top surface so as to have a smaller inclination angle with respect the first tape surface of the fastener tape than that of the peripheral side surface. Further, the intermediate sloped surface of the element base and the intermediate sloped surface of the element tip end portion as described above are formed as the single continuous surface.

Accordingly, it is possible to reflect light on the intermediate sloped surface continuously disposed from the element base to the element tip end portion so as to have a gloss beautifully as a metal, so that the fastener element can appear even thinner and exhibit a closer appearance (show) to a metallic fastener element. Further, not only in the case that the stop claw portion of the slider having the stopping mechanism is disposed so as to correspond to the element tip end portion of the fastener element as described above, but also in the case that the stop claw portion of the slider having the stopping mechanism is disposed so as to correspond to the element base of the fastener element, the stop claw portion can hardly be caught in the intermediate sloped surface and can be lifted upward smoothly upon the start of the sliding operation of the slider.

In this case, the intermediate sloped surface of the element tip end portion is disposed in the tape width direction so as to extend toward the coupling head portion side beyond the most constricted part of the neck portion in the element main body portion. Thus, it becomes possible to gloss more the element tip end portion of the fastener element as a metal.

Further in this case, the first ridge line portion formed between the peripheral side surface and the intermediate sloped surface in the element base is disposed on the outer position than the most constricted part of the neck portion and also the second ridge line portion formed between the intermediate sloped surface and the top surface in the element base is disposed on the inner position than the most constricted part of the neck portion in the tape length direction.

Accordingly, the dimension in the element width direction (tape length direction) of the intermediate sloped surface in the element base is secured, so that the intermediate sloped surface can be formed in a large area. Therefore, a gloss like a metal can be obtained stably by reflecting light with the intermediate sloped surface easily. Further, when the sliding operation of the slider is started, the stop claw portion can hardly be caught in the intermediate sloped surface.

Further in the invention, the maximum dimension (the maximum value of the height dimension) in the tape front and back direction from the element main body portion to the top portion of the element tip end portion in the first projection is set to be larger than a half size of the maximum dimension in the tape front and back direction in the element main body portion.

In such a way that the first projection is formed high from the element main body portion, when the fastener element is viewed from the first surface (upper surface) side, the element main body portion is shadowed by the first projection and can hardly be seen, so that it becomes possible that a shape of the fastener element appears to be thin in the element length direction (tape width direction). As a result, the fastener element can exhibit the closer appearance (show) to a metallic fastener element.

Further, since the first projection is formed high from the element main body portion, for example, when the slide fastener is formed using the slider having the stopping mechanism in which the stop claw portion is disposed so as to correspond to the element tip end portion of the fastener element, it is possible to receive more securely the stop claw portion of the slider on the peripheral side surface of the first projection. Thus the stopping mechanism of the slider can be functioned stably.

Further in the invention, the second projection of the fastener element has a plane-symmetrical shape with the first projection about the center position in the tape front and back direction of the fastener tape. Accordingly, the fastener stringer according to the invention can easily be used for the slide fastener for right-side insertion or left-side insertion by turning it back without altering the shape of the fastener element. As a result, it is unnecessary to manufacture respective dedicated dies for right-side insertion and for left-side insertion as molding dies for the fastener element. Therefore, cost for the molding dies can be suppressed, and the manufacturing cost reduction of the slide fastener can be achieved.

MODES FOR CARRYING OUT THE INVENTION

In the following, a suitable embodiment of the invention will be described in detail with embodiments and with reference to the drawings. Further, not being limited to the embodiment described in the following, the invention can be variously modified, as long as having substantially the same structure as that of the invention and performing similar operational effects.

First Embodiment

Figure 1:
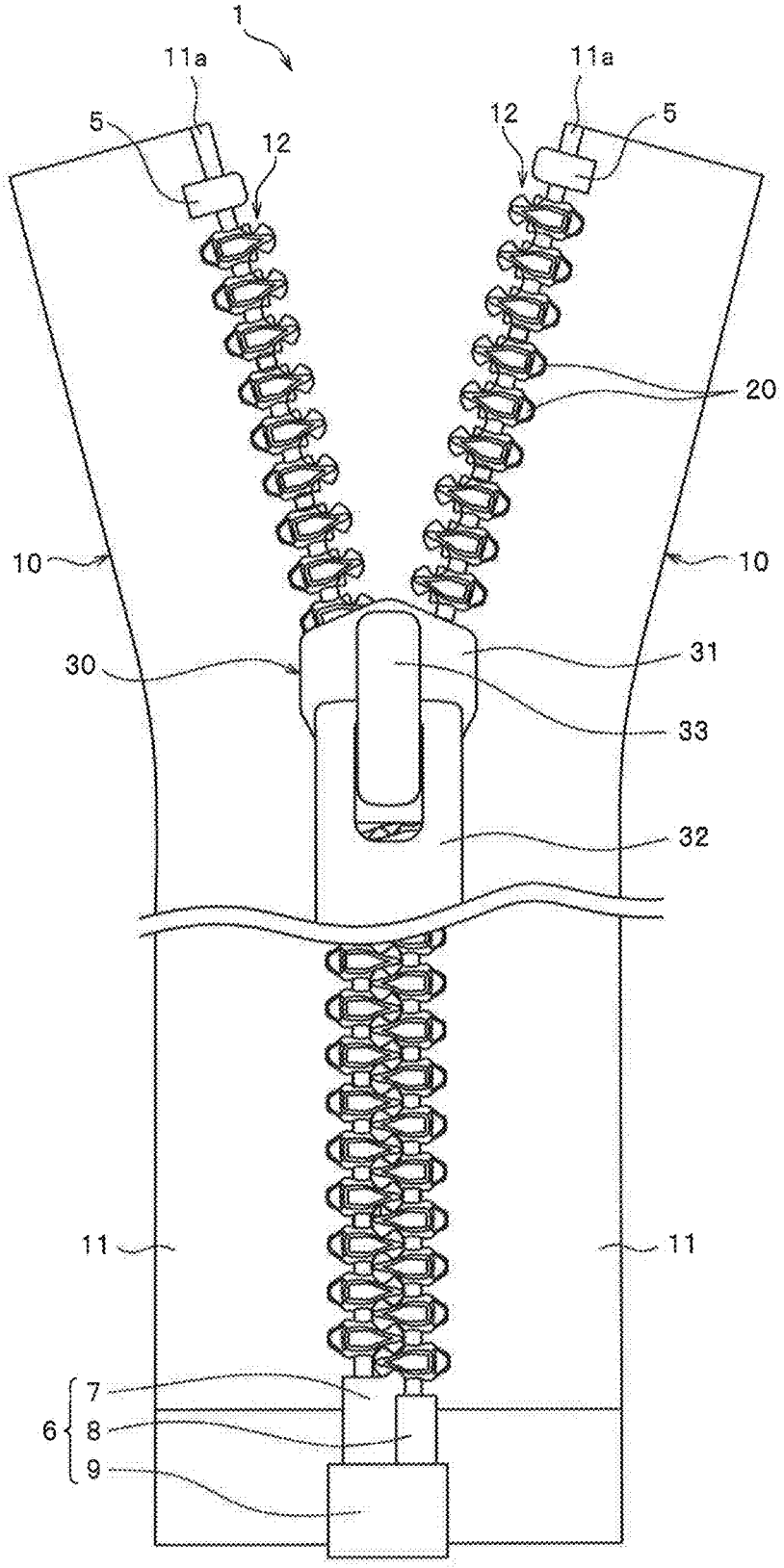
FIG. 1 is a plan view showing a slide fastener which has a fastener stringer according to a first embodiment of the invention.
Figure 2:
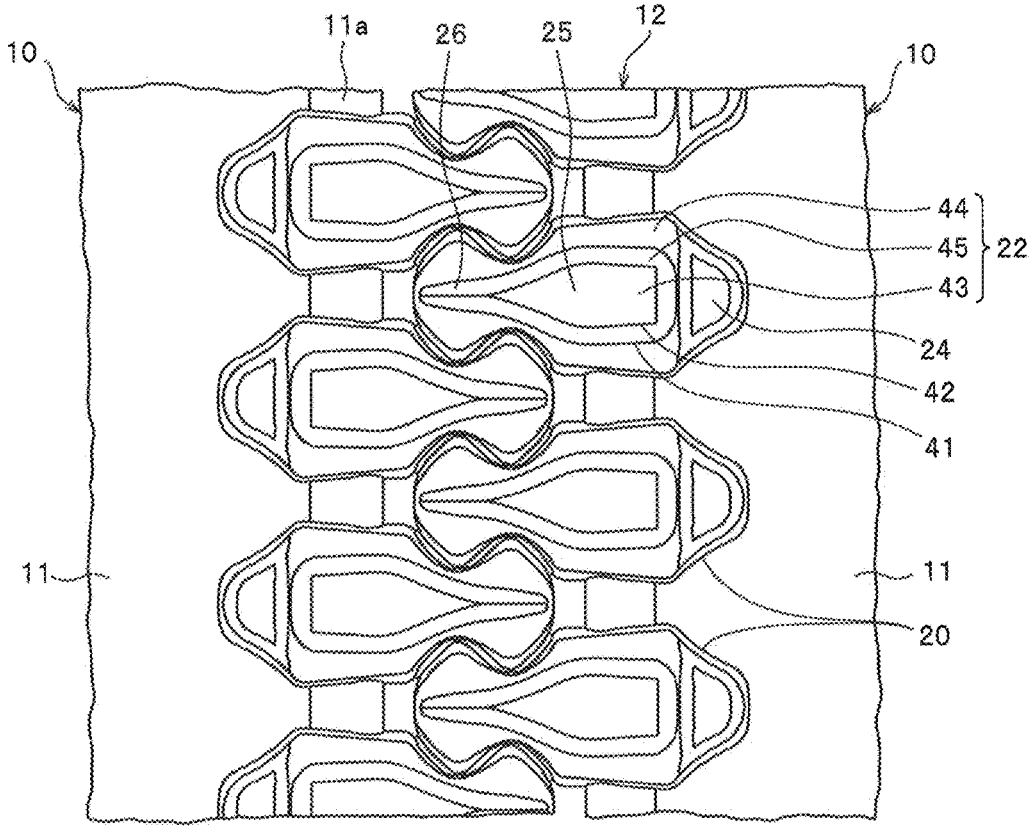
FIG. 2 is an enlarged plan view showing an enlarged main parts of the slide fastener.
Figure 3:
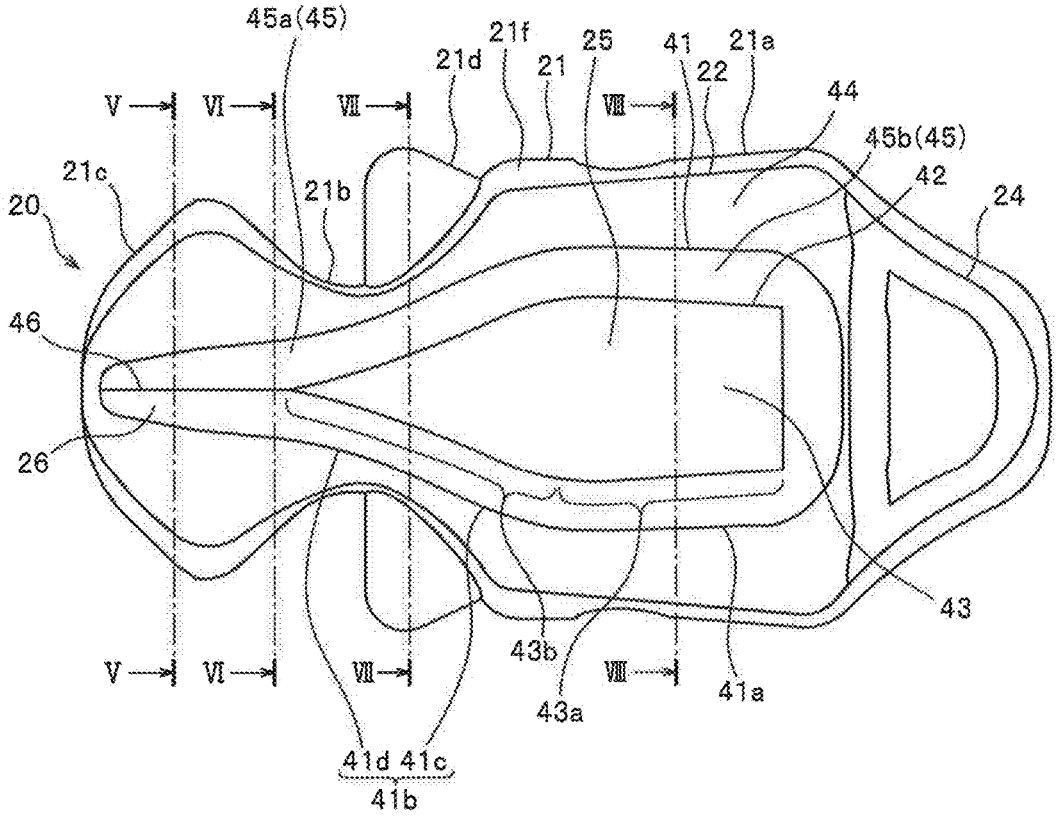
FIG. 3 is a plan view showing an enlarged fastener element of the slide fastener.
Figure 4:
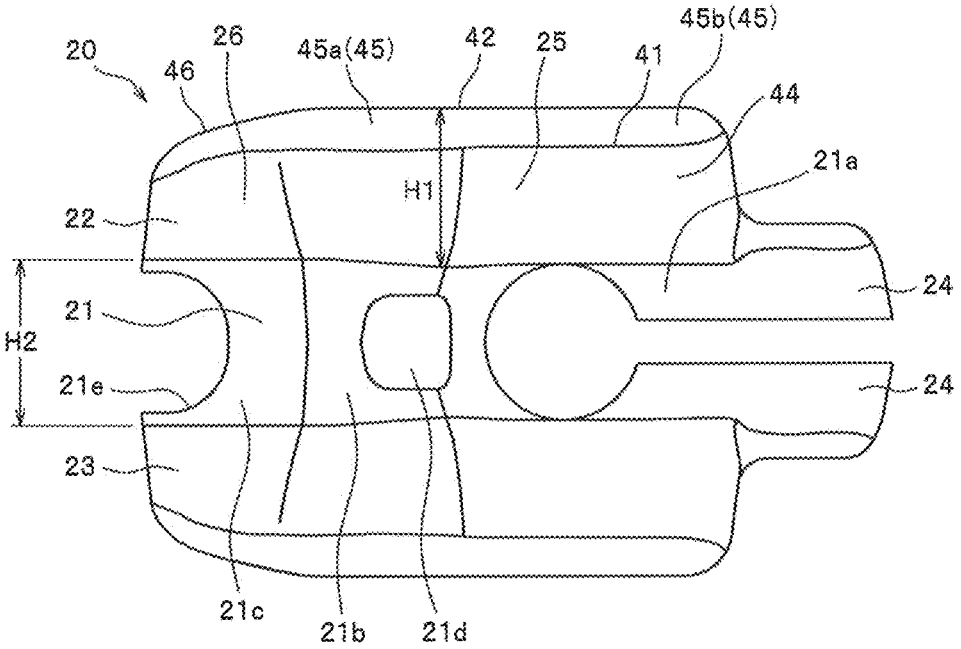
FIG. 4 is a front view of the fastener element when viewed from a tape length direction side.
Figure 5:
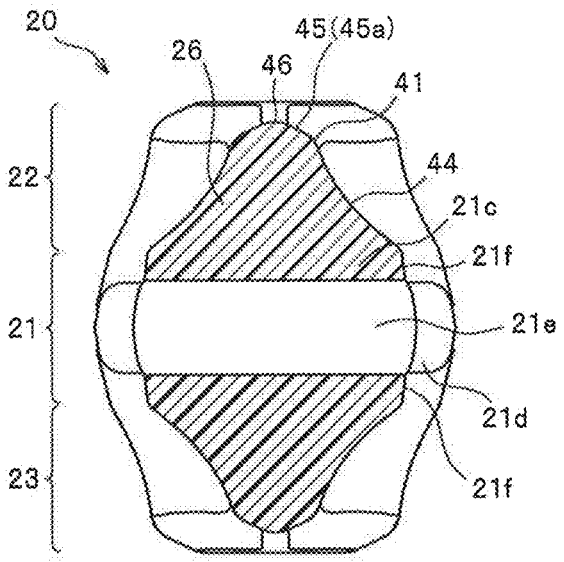
FIG. 5 is an arrow sectional view in V-V line which is shown in FIG. 3.
Figure 6:
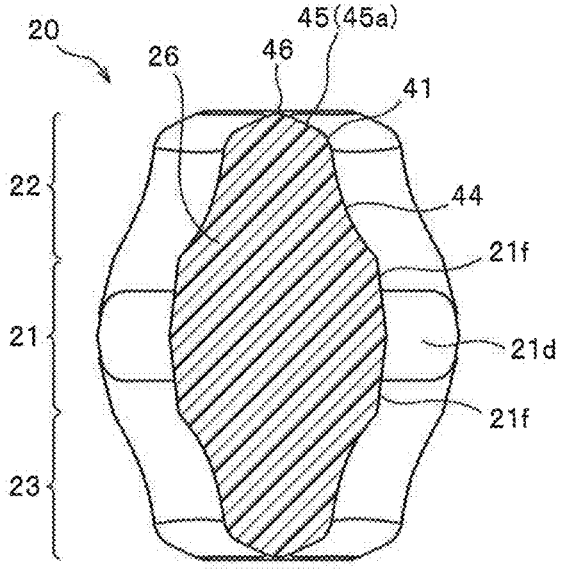
FIG. 6 is an arrow sectional view in VI-VI line which is shown in FIG. 3.

FIG. 1 is a plan view showing a slide fastener which has a fastener stringer according to a first embodiment of the invention. FIG. 2 is an enlarged plan view showing an enlarged main parts of the slide fastener. FIG. 3 and FIG. 4 are a plan view and a front view of a fastener element of the slide fastener. FIG. 5-FIG. 8 are sectional views shown in FIG. 3.

Further, in the description below, a tape length direction of the fastener tape is defined as a top and bottom direction. In particular, a direction in which the slider is slid when closing the slide fastener is defined as a top, and a direction in which the slider is slid when opening the slide fastener is defined as a bottom. Further, a tape width direction of the fastener tape is defined as a left and right direction. In addition, a tape front and back direction of the fastener tape is defined as an upper and lower direction, and a side where a pull tab of the slider is disposed with respect to the fastener tape is defined as an upper, and a side which is opposite to it is defined as a lower.

In addition, regarding the fastener element, a tape length direction may be described as an element width direction, a tape width direction may be described as an element length direction, and a tape front and back direction may be described as an element height direction in order to explain characteristics of the invention clearly.

As shown in FIG. 1, a slide fastener 1 in the first embodiment includes a left and right pair of fastener stringers 10 on which element rows 12 are formed along facing tape side edge portions of left and right fastener tapes 11, first end stops 5 (also referred to as upper end stops) which are disposed adjacent to the element rows 12 at the upper end portions of the fastener stringers 10, a separable bottom end stop 6 which is disposed adjacent to the element rows 12 at the lower end portions of the pair of fastener stringers 10 and a slider 30 with a stopping mechanism which is slidably disposed along the element rows 12.

It should be noted that the slide fastener 1 according to the first embodiment has a main characteristic in a shape of each fastener element 20 forming the element rows 12, and regarding the fastener tapes 11, the first end stops 5, the separable bottom end stop 6 and the slider 30, those substantially same as conventional general slide fastener are used.

For example, the separable bottom end stop 6 of the first embodiment includes an insert pin 7 disposed at the bottom end portion of the left side fastener stringer 10, a box pin 8 disposed at the bottom end portion of the right side fastener stringer 10 and a box 9 integrally molded at the bottom end portion of the box pin 8. The separable bottom end stop 6 is configured for right-side insertion.

Meanwhile, in the invention, for example, a positional relation between the insert pin 7 as well as the box pin 8 and the box 9 is inverted in the left and right direction with respect to the first embodiment, the insert pin 7 is attached to the right side fastener stringer 10, and the box pin 8 and the box 9 are attached to the left side fastener stringer 10, and thereby it is also possible to configure a separable bottom end stop for left-side insertion.

The slider 30 in the first embodiment includes a slider body 31, a pull tab 32 having an attaching shaft portion at one end portion, a pull tab holding body 33 holding the attaching shaft of the pull tab 32 rotatably to the slider body 31, a stop claw body 34 which is held by the slider body 31 and has a stop claw portion 34*a*, a plate spring member 35 which energizes the stop claw body 34 downward, a slide member 36 disposed on the slider body portion 31 slidably along a slider length direction (top and bottom direction), and a spring member which is not illustrated and which energizes the slide member 36 toward the rear opening side.

In the first embodiment, the slider 30 has a stopping mechanism which holds a position where it stops with respect to the element rows 12, by energizing the stop claw body 34 with the plate spring member 35 and engaging the stop claw portion 34*a* of the stop claw body 34 with the fastener element 20 of the element rows 12 when finishing the sliding operation of the slider 30 by the pull-tab 32.

Further, the slide member 36 of the slider 30 includes a first block portion on the bottom side and a second block portion on the top side which are formed in a convex shape in the upper direction, and is disposed slidably on an upper blade 31*a* of the slider body 31. The slide member 36 is slid in a slider length direction, thereby it becomes possible that the pull tab 32 is attached between the slider body 31 and the pull tab holding body 33, and that the pull tab 32 which is supported between the slider body 31 and the pull tab holding body 33 is detached.

The slider body 31 according to the first embodiment includes an upper blade 31*a* and a lower blade, a guide column 31*b* connecting between shoulder openings side end portions of the upper blade 31*a* and the lower blade, a flange portion 31*f* disposed on left and right side edge portions of the upper blade 31*a* and the lower blade, an attaching column 31*c* which stands on upper surface of the upper blade 31*a* and attaches the pull tab holding body 33, a pivot convex portion 31*d* standing on the bottom side position of the attaching column 31*c* and pivots the stop claw body 34 oscillatably.

Further, on a top end portion of the slider body 31, left and right shoulder openings are formed with the guide column 31*b* being between them. On a bottom end portion of the slider body 31, a rear opening is formed. Between the upper and lower blades of the slider body 31, a Y-shaped element guide pass which passes through the left and right shoulder openings and the rear openings is formed.

On a predetermined position of the upper blade 31*a*, a claw hole 31*e* which penetrates an element guide pass from the upper surface of the upper blade 31*a* is formed. Further, on the upper surface side of the upper blade 31*a*, a slide member accommodating portion concaved from the bottom end of the upper blade 31*a* to the left and right side portions of the claw hole 31*e* and with which the slide member 36 is fitted and slid, and a stopper portion which is disposed at the bottom end portion of the upper blade 31*a* and prevents the slide member 36 accommodated in the slide member accommodating portion from falling off in the bottom direction.

The pull tab holding body 33 has a curved shape which curves downward in a substantially concave shape. An internal space surrounded by left and right side wall portions and a ceiling portion is formed inside the pull tab holding body 33. The pull tab holding body 33 is attached with respect to the slider body 31 at a cantilever state such that the one end portion (fixing end portion) is fixed to the attaching column 31*c* of the upper blade 31*a*. Further, on an inner wall surface side in the ceiling portion of the pull tab holding body 33, a plate spring member 35 is held so as to energize the stop claw body 34 downward.

The stop claw body 34 includes a claw body base on which a pivot concave groove pivoting a pivot convex portion 31*d* of the slider body 31 formed, upper and lower arm portions which diverge from the claw body base and extend and a stop claw portion 34*a* which bents downward from the tip end portion of the lower arm portion and protrude into the element guide pass via the claw hole 31*e* of the slider body 31. Further, an operational concave groove in which the attaching shaft portion of the pull tab 32 is inserted is provided between the upper and lower arm portions.

Figure 9:
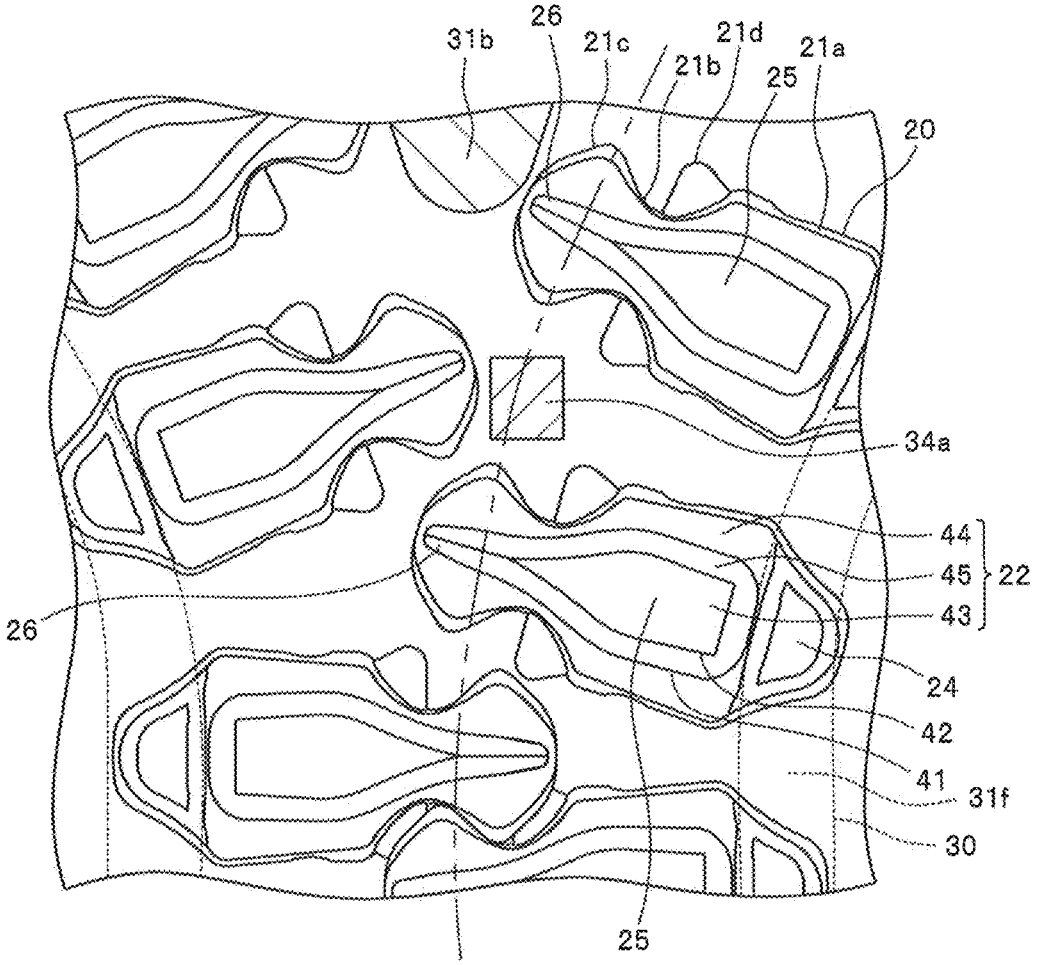
FIG. 9 is a local sectional view showing a positional relation between a fastener element and a stop claw portion of a slider.
Figure 10:
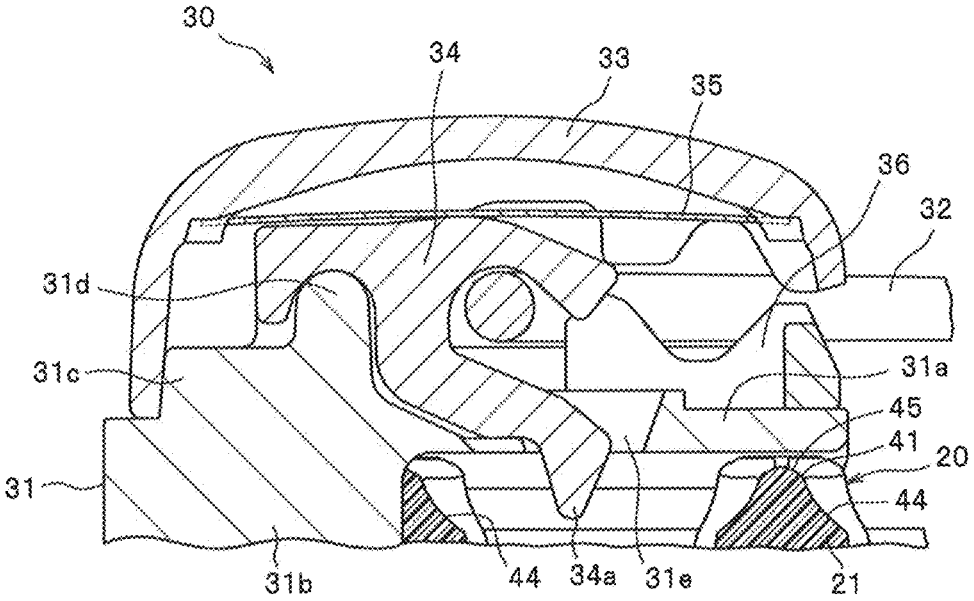
FIG. 10 is a sectional view showing a state that a stop claw portion of a slider is protruded inside an element guide pass.

In this case, when the stop claw portion 34*a* of the stop claw body 34 is protruded into the element guide pass, as shown in FIG. 9, the stop claw portion 34*a* is disposed on a position which is capable of being engaged to the fastener elements 20 of the right side element rows 12. Further, an illustration of the fastener tape 11 is omitted in FIG. 9.

Especially in the first embodiment, the stop claw portion 34*a* is disposed on a position corresponding to a position of the element tip end portion 26 which is described later so as to be capable of being engaged with the element tip end portion 26 of the fastener element 20. Further, the stop claw body 34 is energized by the plate spring member 35, thereby the stop claw portion 34*a* is configured so as to protrude into the element guide pass to a position (depth) which is capable of being engaged with a peripheral side surface 44 described later of the element tip end portion 26.

In the first embodiment, the fastener tape 11 of each of the fastener stringers 10 is woven or knitted in a belt shape. The fastener tape 11 includes a tape main portion sewn to fastener-attached products (such as clothing and bags) and a tape side edge portion (also referred to as an element attaching portion) along which an element row 12 is formed.

Further, core thread portions 11*a* are disposed at tape side edges facing each other of the left and right fastener tapes 11. The element row 12 is formed by attaching a plurality of fastener elements 20 made of synthetic resin at regular intervals in the tape length direction to a tape side edge portion including the core thread portion 11*a* of the fastener tape 11.

Each fastener element 20 includes an element main body portion 21 fixed so as to extend across a tape upper surface (a first tape surface) and a tape lower surface (a second tape surface) of the fastener tape 11, a first projection (upper projection) 22 projecting upward from an upper surface of the element main body portion 21, a second projection (lower projection) 23 projecting downward from a lower surface of the element main body portion 21 and fin portions 24 extending toward a tape inside from an end edge portion on a tape inner side of the element main body portion 21 as well as the first and the second projections 22 and 23.

The element main body portion 21 of the fastener element 20 includes a body portion 21*a* fixed so as to extend across the tape upper surface and the tape lower surface such that the core thread portion 11*a* of the fastener tape 11 is covered, a neck portion 21*b* which extends tape outward direction from the body portion 21*a* and has a constricted shape, a coupling head portion 21*c* which extends further tape outward direction from the neck portion 21*b* and is capable of being engaged with a counterpart fastener element 20, and a pair of top and bottom shoulder portions 21*d* which protrude from the neck portion 21*b* in the element width direction.

In order that the body portion 21*a* of the element main body portion 21 ensures fixing strength of the fastener element 20 with respect to the fastener tape 11, a dimension in the element width direction of a tape fixing surface which fixes on the tape upper surface and the tape lower surface of the fastener tape 11 in the body portion 21*a* of the element body portion 21 is set to have a same size as the element width dimension of the tape fixing surface in a conventional fastener element as in Patent Document 1 and Patent Document 2 as described above, for example.

Further, for example, in a case that fixing strength of the fastener element 20 with respect to the fastener tape 11 is sufficiently obtained, it is possible to set the element width dimension of the tape fixing surface in the body portion 21*a* to be smaller than the element width dimension of the conventional fastener element, and also to be larger than the element width dimension of the conventional fastener element when necessary.

The neck portion 21*b* of the element body portion 21 has a constricted shape such that the dimension in the element width direction (element width dimension) is small in order to enable the coupling head portion 21*c* of the element main body portion 21 of a coupling counterpart to be fitted. The coupling head portion 21*c* of the element main body portion 21 is formed to be an elliptical shape so as to protrude in the element width direction more than the first and the second projections 22 and 23. Further, the coupling head portion 21*c* is formed to be larger than the element width dimension of the neck portion 21*b*.

Further, in the tip end portion of the coupling head portion 21*c*, a concave groove portion 21*e* which is capable of fitting the shoulder portions 21*d* of the element main body portion 21 of the coupling counterpart is disposed along the tape length direction (element width direction) so as to be concaved from a tip end surface of the coupling head portion 21*c*. The shoulder portions 21*d* of the element main body portion 21 are formed to have a shape and a size which is capable of fitting into the concave groove portion 21*e* formed in the coupling head portion 21*c* of the coupling counterpart.

By the element main body portion 21 of each fastener element 20 having such a shape as mentioned above, the left and right fastener elements 20 can be coupled or separated smoothly when the slide fastener 1 is opened and closed by sliding the slider 30. It is also possible to stably obtain sufficient coupling strength to withstand the use of the slide fastener 1 when the left and right fastener elements 20 are coupled.

Further, the element main body portion 21 is disposed in a center part in the tape front and back direction (element height direction) of the fastener element 20 so as to extend across the tape upper surface and the tape lower surface in the fastener tape 11. Thereby, it can enhance effectively the coupling strength (lateral pulling force and push-up force) of the left and right element rows 12 with respect to the pulling force in the tape width direction and the push-up force in the tape front and back direction, compared to the slide fastener in which the coupling head portion is disposed only in the tape back surface side of the tape front and back surface, as shown in, for example, FIG. 1 of Patent Document 1.

Further, in the first embodiment, for example, when a cross section which is orthogonal to the tape width direction of the fastener element 20 is viewed (see FIG. 5-FIG. 8), the peripheral side surface 21*f* on the top and bottom which faces to the tape length direction of the element main body portion 21 is formed as a sloped surface which slopes with respect to the tape front and back direction such that the element width dimension of the element main body portion 21 gradually increases toward the upper surface of the element main body portion 21 from the tape fixing surface with the fastener tape 11.

Since the peripheral side surface 21*f* on the top and bottom sides of the element main body portion 21 is formed as the sloped surface, it becomes possible to have a smaller element width dimension in a top surface 43, which is described later, of the first projection 22. Further, in the invention, it is also possible that the peripheral side surface 44 on the top and bottom sides in a part (for example, the neck portion 21*b*) or in all of the element main body portion 21 is formed as a vertical surface which is orthogonal with respect to the tape upper surface of the fastener tape 11.

The first projection 22 of the fastener element 20 is on an exposed surface side which is exposed outside in the slide fastener 1. Further, in the first embodiment, the first projection 22 and the second projection 23 have a plane-symmetrical shape each other about a center position in the tape front and back direction of the fastener tape 11. Therefore, in the following, the first projection 22 is explained in detail, and the detailed explanation regarding the second projection 23 is omitted.

The first projection 22 includes an element base 25 which is disposed on the body portion 21*a* of the element main body portion 21 and the element tip end portion 26 which extends tape outer side in the tape width direction (coupling head portion 21*c* side) from the element base 25, and has a tapered shape.

In this case, the element tip end portion 26, in a plan view of the fastener element 20 (see FIG. 3), is formed such that a shape formed by a first ridge line portion 41 between a peripheral side surface 44 and an intermediate sloped surface 45, which are described later, of the first projection 22

(in other words, a shape of an upper half portion of the first projection 22 disposed on upper side than the first ridge line portion 41) has a tapered shape in which the element width dimension gradually decreases from a base end portion on a side connecting with the element base 25 toward the tip end portion. Further, the first ridge line portion 41 formed between the peripheral side surface 44 and the intermediate sloped surface 45 is formed in a curved shape which is round as it is chamfered in a tip end edge of the element tip end portion 26.

An outer surface of the first projection 22 includes a top surface (upper surface) 43 which is disposed on the farthest position from the tape upper surface of the fastener tape 11, the peripheral side surface 44 which is disposed so as to rise from the element main body portion 21 via a ridge line portion, and the intermediate sloped surface 45 which is disposed between the top surface 43 and the peripheral side surface 44.

In this case, each of the top surface 43, the peripheral side surface 44 and the intermediate sloped surface 45 of the first projection 22 is differentiated by forming a ridge line portion (first ridge line portion 41 and second ridge line portion 42) between other surfaces. Further, in the first embodiment, a top portion (upper end portion) of the first projection 22 is configured by the top surface 43 of the first projection 22 and an upper end ridge line portion 46 which is disposed closer to a tip end side of the element tip end portion 26 than the top surface 43 and is formed between the intermediate sloped surface 45 on the top side and the intermediate sloped surface 45 on the bottom side.

The top surface 43 of the first projection 22 is disposed parallel to the tape upper surface of the fastener tape 11. Further, a part of the top surface 43 of the first projection 22, for example, may be formed as a sloped surface which slopes downward toward a tip end of the element tip end portion 26 or a curved surface.

In the element width direction (tape length direction), the top surface 43 of the first projection 22 is formed within a further inner region than a region from the peripheral side surface 44 on a top side to the peripheral side surface 44 on a bottom side of a part in which a dimension of the element width direction in the neck portion 21*b* of the element main body portion 21 is the smallest (the most constricted part of the neck portion 21*b*).

Further, in the element length direction (tape width direction), the top surface 43 of the first projection 22 is disposed at least from a position closer to the tape inner side than the core thread portion 11*a* of the fastener tape 11 to a position closer to the tape outer side than the most constricted part in the neck portion 21*b* of the element main body portion 21, and to a position closer to the tape outer side than the shoulder portions 21*d* of the element main body portion 21.

Further, in a plan view of the fastener element 20 (see FIG. 3), the top surface 43 of the first projection 22 includes a base end region 43*a* in which the element width dimension in the top surface 43 gradually increases and a narrow width region 43*b* in which the element width dimension in the top surface 43 gradually decreases from an end edge on the tape inner side of the top surface 43 toward a tip end of the element tip end portion 26. Thereby, the fastener element 20 becomes possible to appear to be thin as a whole, and it is possible to exhibit a closer appearance (show) with a metallic fastener element.

Further, in such a way that the first and the second projections 22 and 23 of the fastener element 20 include top surfaces 43, the top surfaces 43 of the first and the second projections 22 and 23 and an inner wall surface of the upper blade 31*a* and the lower blade in the slider 30 can be disposed to be substantially parallel. Thereby, a direction of the slider 30 with respect to the element rows 12 of the fastener stringer 10 can be stabilized and the preferable sliding property of the slider 30 can be ensured.

Further, the upper end ridge line portion 46 which forms the top portion of the first projection 22 along with the top surface 43 as described above is formed so as to slope downward toward the tip end of the element tip end portion 26 between the intermediate sloped surface 45 on the top side and the bottom side, as shown in FIG. 4. Thereby, touch (feeling of touch) of the fastener element 20 can be enhanced. Further in this case, the upper end ridge line portion 46 may slope downward linearly or slope downward in a curved way toward the tip end of the element tip end portion 26, and also may be formed to have both the linear sloped portion and the curved sloped portion.

Further in the first embodiment, a maximum value H1 of a dimension in the tape front and back direction (height dimension) from the element main body portion 21 to the top portion (top surface 43) in the element tip end portion 26 of the first projection 22 is set be larger than a half size of the maximum dimension H2 in the tape front and back direction in the element main body portion 21. In this case, it is preferable that the maximum height dimension H1 of the first projection 22 is set to be 150% or more of the half size of the maximum height dimension H2 of the element main body portion 21.

Since the element tip end portion 26 is formed to be high from the element main body portion 21 as described above, when the fastener element 20 is viewed from upper side, the element main body portion 21 is shaded by the first projection 22, and thus can be less visible. Thereby, it becomes possible that the fastener element 20 appears to be thinner in the element length direction, and it is possible to exhibit the closer appearance with a metallic fastener element.

The peripheral side surface 44 of the first projection 22 is formed upward so as to rise from the element main body portion 21. Further, in order that the top surface 43 is easily formed to be thin as described above, when the cross section orthogonal to the tape width direction of the fastener element 20 is viewed (see FIG. 5-FIG. 8), the peripheral side surface 44 facing the top side and the bottom side in the first projection 22 is formed to be sloped obliquely with respect to the tape front and back direction such that the element width dimension of the first projection 22 gradually decreases upward from the element main body portion 21.

Figure 7:
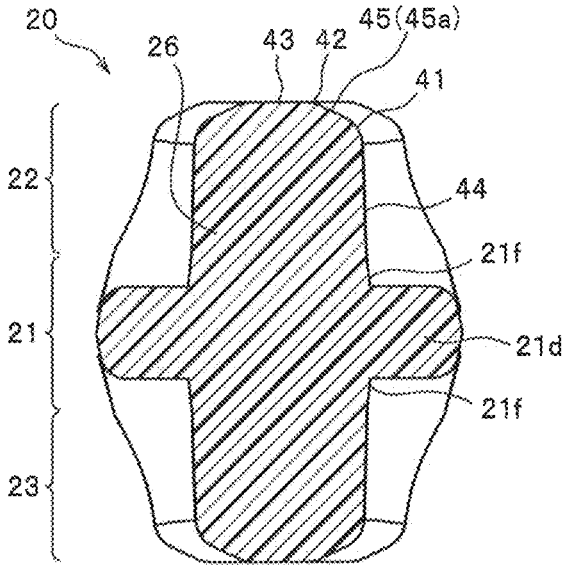
FIG. 7 is an arrow sectional view in VII-VII line which is shown in FIG. 3.
Figure 8:
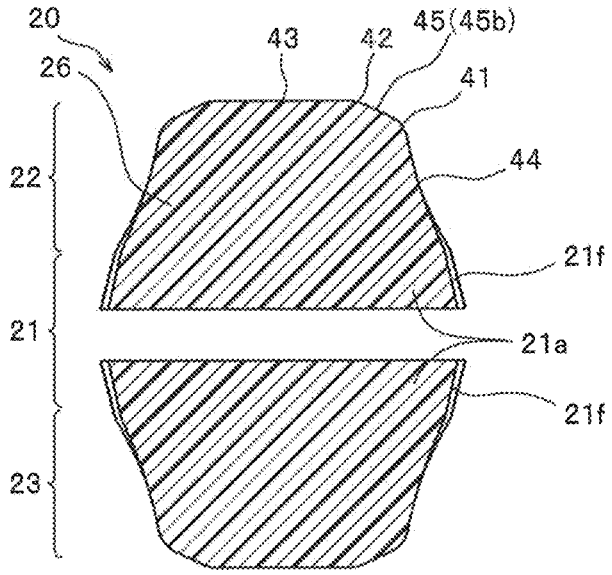
FIG. 8 is an arrow sectional view in VIII-VIII line which is shown in FIG. 3.

Especially, the peripheral side surface 44 on the top and bottom sides is formed as a curved surface (concave surface) which curves in a concave shape so as to be concaved toward the inside of the element. Further, it is preferable that the concaved curved surface which is to be the peripheral side surface 44 of the first projection 22 is formed continuously along the element length direction from the body portion 21*a* to the coupling head portion 21*c* of the element main body portion 21. However, in the first embodiment, since a part of the area which corresponds to the neck portion 21*b* of the element main body portion 21 out of the first projection 22 is formed to be thin in the element width direction, the peripheral side surface 44 which corresponds to the neck portion 21*b* is formed as a concaved curved surface with small curvature or an sloped surface which is close to a plane surface, as shown in FIG. 7, for example.

Since the peripheral side surface 44 on the top and bottom sides of the first projection 22 is formed as a concave shape as described above, when the fastener element 20 is viewed from upper side, the peripheral side surface 44 on the top and bottom sides becomes less visible. In addition, since directions of light reflection are changed by the concaved peripheral side surface 44 as described above, light becomes less scattered toward the element upper side on the peripheral side surface 44 of the first projection 22. As a result, the peripheral surface 44 of the first projection 22 becomes to appear to be darker as a shadow than the top surface 43 of the first projection 22, and the first projection 22 becomes to appear further narrower in the element width direction.

Further, in the first embodiment, although the peripheral side surface 44 on the top and bottom sides is formed as the concaved curved surface as described above, in this case, a sloped direction of the concaved peripheral side surface 44 is an angle of a straight line which connects the ridge line portion between the peripheral side surface 44 of the first projection 22 and the peripheral side surface 21*f* of the element main body portion 21, and a first ridge line portion 41 between the peripheral side surface 44 of the first projection 22 and the intermediate sloped surface 45 in a cross section which is orthogonal to the tape width direction.

The intermediate sloped surface 45 of the first projection 22 is disposed between the peripheral side surface 44 of the first projection and the top surface 43, and is connected to the peripheral side surface 44 and the top surface 43 via the first and the second ridge line portions 41, 42 respectively. Further, when the cross section orthogonal to the tape width direction of the fastener element 20 is viewed (see FIG. 5-FIG. 8), the intermediate sloped surface 45 on the top and bottom sides in the first projection 22 is formed to be sloped obliquely with respect to the tape front and back direction (element height direction) such that the element width dimension of the first projection 22 gradually decreases from the first ridge line portion 41 of the first projection 22 to the second ridge line portion 42.

Especially in the first embodiment, the intermediate sloped surface 45 on the top and bottom sides is formed in a flat shape (tapered) which slopes upward from the first ridge line portion 41 of the first projection 22 toward the second ridge line portion 42. Further in this case, an inclination angle of the intermediate sloped surface 45 with respect the tape upper surface of the fastener tape 11 is formed to be smaller than that of the peripheral side surface 44 of the first projection 22.

In the element length direction (tape width direction), the intermediate sloped surface 45 on the top and bottom sides in the first projection 22 is formed as a single continuous surface which is continuously disposed without including a ridge line portion from the element base 25 to the element tip end portion 26. In this case, the intermediate sloped surface 45 on the top and bottom sides includes a first intermediate sloped surface 45*a* which is disposed on the element tip end portion 26 and a second intermediate sloped surface 45*b* which is disposed on the element base 25.

Especially, in the element length direction, the intermediate sloped surface 45 on the top and bottom sides in the first embodiment is disposed at least so as to be extended from a position closer to the tape inner side than the core thread portion 11*a* of the fastener tape 11 beyond the most constricted part of the neck portion 21*b* in the element main body portion 21 to the tip end side, preferably beyond the most swollen part in the element width direction of the coupling head portion 21*c* in the element main body portion 21 to the tip end side.

Further, in order to ensure the area of the second intermediate sloped surface 45*b* to be large by having a large element width dimension to some extent, the second intermediate sloped surface 45*b* on the top and bottom sides in the element base 25 of the first projection 22 is formed such that in the element width direction (tape length direction) the second ridge line portion 42 formed between the second intermediate sloped surface 45*b* and the top surface 43 is disposed on an inner position than the most constricted portion of the neck portion 21*b*, and the first ridge line portion 41 formed between the second intermediate sloped surface 45*b* and the peripheral side surface 44 is disposed on an outer position than the most constricted portion of the neck portion 21*b*.

Further in the first embodiment, as substantially the same with the shape of the top surface 43 of the first projection 22, in a plan view of the fastener element 20 (see FIG. 3), a shape of the first ridge line portion 41 formed by the intermediate sloped surface 45 and the peripheral side surface 44 of the first projection 22, includes a base end region 41*a* in which the element width dimension gradually increases or keeps the same width toward the tip end side, and a narrow width region 41*b* in which the element width dimension gradually decreases toward the tip end side. Further, the narrow width region 41*b* includes a first narrow width region 41*c* which is disposed on the base end region 41*a* side and is formed so as to swell outward in a convex shape, and a second narrow width region 41*d* which is disposed on the tip end side via an inflection portion from the first narrow width region 41*c* and is formed so as to concave inward in a concave shape.

Further, an area of the sloped surface which is disposed so as to be held between the first ridge line portion 41 and the second ridge line portion 42 in the intermediate sloped surface 45 is formed such that a minimum distance between the first ridge line portion 41 and the second ridge line portion 42 (or element width dimension) is substantially constant.

In this case, in order to exhibit a gloss stably by reflecting light at the intermediate sloped surface 45, it is preferable that the minimum distance between the first and the second ridge line portions 41 and 42 (or element width dimension) in the intermediate sloped surface 45 is set be 0.2 mm or more. Further, it is preferable that an inclination angle of the intermediate sloped surface 45 with respect to the tape upper surface of the fastener tape 11 is set to be from 5° to 45°.

Since the intermediate sloped surface 45 as described above is formed on the first projection 22 in the first embodiment, when the fastener element 20 is viewed from upper side, the fastener element 20 can appear to be thinner in the element length direction, and can further be close to a metallic fastener element. Further, besides the top surface 43 and the peripheral side surface 44 of the first projection 22, the intermediate sloped surface 45 reflects light in a different direction from the top surface 43 and the peripheral side surface 44, and the fastener element 20 can have a gloss like a metal.

Due to a presence of the intermediate sloped surface 45, even if in a case that the top surface 43 of the first projection 22 is formed to be thin in the tape width direction as described above, the strength of the first projection 22 can be enhanced by ensuring a dimension between the peripheral side surface 44 on the top side and the peripheral side surface 44 on the bottom side in the first projection 22 comparatively larger.

Thereby, even if, for example, a height dimension of the first projection 22 (dimension in the tape front and back direction) from the element main body portion 21 is set be larger in order that the element main body portion 21 is less visible, failures such as chipping or breaking of the first projection 22 can be less caused in such a case that the stop claw portion 34*a* of the slider 30 is engaged with the first projection 22.

The fin portions 24 of the fastener element 20 are disposed on the tape upper surface side and the tape lower surface side of the fastener tape 11. The fin portion 24 disposed on the tape upper surface side and the fin portion 24 disposed on the tape lower surface side have a plane-symmetrical shape each other about the center position of the tape front and back direction of the fastener tape 11. Further, the fin portions 24 on the tape upper surface side and the tape lower surface side are formed such that the element width dimension from an end portion of the element main body portion 21 side toward the tape inner side gradually decreases, and has an approximately mountain shape in a plan view of the fastener element 20.

The fixing strength of the fastener element 20 with respect to the fastener tape 11 can be increased by such fin portions 24 being disposed. Additionally, the fin portions 24 of the fastener element 20 are disposed so as to correspond to the positions where flange portions 31*f* of the slider 30 pass when the slider 30 is slid, so that it is possible to prevent the flange portions 31*f* of the slider 30 from contacting with the fastener tape 11 directly. Accordingly, when the slider 30 is slid, it is possible to prevent the fastener tape 11 from being damaged by such as scratching or cutting, due to contact of the fastener tape 11 with the flange portions 31*f*.

Further, since the fastener element 20 in the first embodiment has a plane-symmetrical shape about the center position in the tape front and back direction of the fastener tape 11 as described above, it is possible to form the slide fastener 1 in which the first projection 22 side of the fastener element 20 becomes to be an exposed surface side which is exposed to the outside or the second projection 23 side of the fastener element 20 becomes to be an exposed surface side which is exposed to the outside.

Thereby, when a slide fastener for right-side insertion or a slide fastener for left-side insertion is manufactured, for example by altering a direction to which the slider 30 is attached or the like, the slide fastener 1 can be manufactured easily at a low cost by arbitrarily selecting right-side insertion or left-side insertion, without changing molding dies for the fastener element 20.

In the slide fastener 1 in the first embodiment, the fastener element 20, the first end stop 5 and the separable bottom end stop 6 are formed by injection-molding thermoplastic polyacetal resin. In this case, flat metal fine pieces made of aluminum or aluminum alloy are uniformly kneaded in polyacetal resin forming the fastener element 20, the first end stop 5 and the separable bottom end stop 6.

Further, in the invention, a kind of synthetic resin forming the fastener element 20, the first end stop 5, and the separable bottom end stop 6 is not limited to polyacetal resin as described above, and other synthetic resins such as polyamide, polypropylene, polybutylene terephthalate, nylon, polycarbonate and the like can also be used, for example. A fastener element 20 formed using such synthetic resin is greatly lightened in weight compared to a metallic fastener element.

Further, polyacetal resin as described above has permeability, so that by selecting polyacetal resin as the material for the fastener element 20, the first end stop 5 and the separable bottom end stop 6, a stable gloss by metal fine pieces can be obtained when metal fine pieces are dispersed in the synthetic resin. In this case, as metal fine pieces which are kneaded in synthetic resin, for example, metal fine pieces as described in Patent Document 2 are used. Further, content (kneading amount) of metal fine pieces which are kneaded in the synthetic resin is also set to be in the range as described in Patent Document 2.

In the slide fastener 1 in the first embodiment as described above, the first projection 22 of the fastener element 20 includes the top surface 43, the peripheral side surface 44 which slopes in a concave shape and the intermediate sloped surface 45 in a plane shape which has a different inclination angle with respect to the top surface 43 and the peripheral side surface 44 as well as the fastener tape 11. Further, the intermediate sloped surface 45 is formed as a single surface which continues from the element base 25 to the element tip end portion 26 in the first projection 22.

Thereby, for example when the slide fastener 1 is viewed from upper side as shown in FIG. 1 and FIG. 2, the top surface 43 of each of the fastener elements 20 (or the top portion including the top surface 43 and the upper end ridge line portion 46) can appear to be thin in the tape width direction. In addition to that, the peripheral side surface 44 on the top and bottom sides of the first projection 22 and the element main body portion 21 can be less visible. Therefore, the shape of the fastener element 20 in the first embodiment has a thin appearance close to the metallic fastener element.

Additionally, since in the fastener element 20, metal fine pieces are dispersed in the resin forming the fastener element 20, a gloss by metal fine pieces can be obtained. Further, the top surface 43 and the intermediate sloped surface 45 of the first projection 22 are formed with different inclination angle each other, so that a different feeling of gloss can be obtained on the respective surfaces by reflecting lights toward different directions on the top surface 43 and the intermediate sloped surface 45.

Further in this case, contrast between the top surface 43 and the intermediate sloped surface 45 of the first projection 22 in which gloss of metal fine pieces is easily seen by reflection of light, and the peripheral side surface 44 of the first projection 22 in which reflection of light is difficult to be seen, is remarkably appeared, so that it is possible to emphasize the thinness of the top surface 43 and the gloss of the top surface 43 and the intermediate sloped surface 45.

Accordingly, in the slide fastener 1 in the first embodiment, the appearance of the fastener element 20 can be made much closer to that of the metallic fastener element 20. Therefore, the slide fastener 1 in the first embodiment becomes to be lighter in weight and to be easier to use than a slide fastener to which conventional metallic fastener elements are attached, and they look stylish or give a fashionable impression better than the slide fastener to which conventional fastener elements made of synthetic resin are attached, which is excellent in appearance quality and design.

Figure 11:
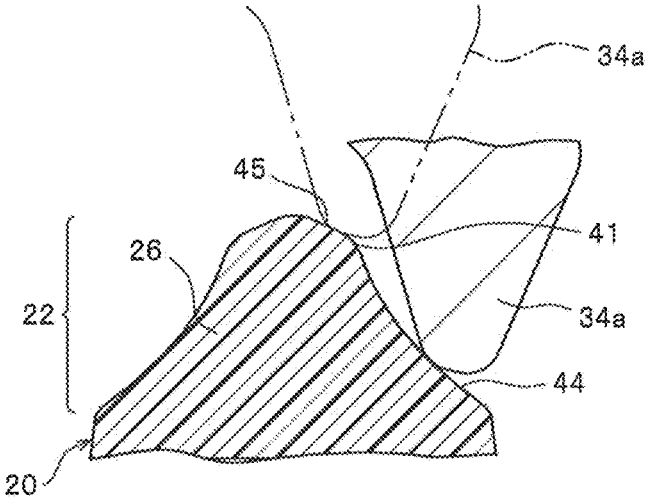
FIG. 11 is a schematic view showing a movement in which a stop claw portion of a slider is lifted up while being slidably in contact with a first projection in a fastener element.

Further, since in the slide fastener 1 in the first embodiment, the peripheral side surface 44 on the top and bottom sides of the first projection 22 in each fastener element 20 is formed as a concaved curved surface, as shown in FIG. 11, for example, when the stop claw portion 34*a* of the slider 30 is inserted into a gap between adjacent fastener elements 20 in the tape length direction and is engaged with the first projection 22 of the fastener element 20, the stop claw portion 34*a* can be securely received by the concaved peripheral side surface 44 formed on the first projection 22 and hardly separated. Thereby, it becomes possible that a stopping state of the slider 30 is stably maintained by the engagement of the stop claw portion 34*a* with the fastener element 20.

Further, in the slide fastener 1 in the first embodiment, the intermediate sloped surface 45 in a plane shape is formed between the peripheral side surface 44 and the top surface 43 of the first projection 22 in each of the fastener elements 20. Thereby, for example, when the sliding operation of the slider 30 is started by pulling the pull tab 32 of the slider 30 from the state in which the stop claw portion 34*a* of the slider 30 is engaged with the fastener element 20 and a stop of the slider 30 is maintained, the stop claw portion 34*a* of the slider 30 can hardly be caught in the fastener element 20.

That is, when the sliding operation of the slider 30 is started, as shown in a virtual line in FIG. 11, the stop claw portion 34*a* of the slider 30 which is engaged with the peripheral side surface 44 of the first projection 22 can hardly be caught in the first projection 22 of the fastener element 20 by rising upward smoothly while contacting slidably with the intermediate sloped surface 45 which slopes more gently than the peripheral side surface 44 continuously.

Thereby, it can prevent the operational property of the slider 30 from decreasing. Further, the user does not slide the slider 30 by force by pulling hardly the pull tab 32 of the slider 30, so that it is possible to prevent a breakage of the stop claw portion 34*a* and the breakage of the fastener element 20 due to a catch of the stop claw portion 34*a*.

Further, in the slide fastener 1 in the first embodiment, as shown in FIG. 9, the stop claw portion 34*a* of the slider 30 is disposed so as to protrude inside the element guide pass in a position corresponding to a position of the element tip end portion 26 of the fastener element 20.

However, in the first embodiment, since the peripheral side surface 44 and the intermediate sloped surface 45 of the first projection 22 are disposed continuously on the element base 25 and the element tip end portion 26, the stop claw portion 34*a* of the slider 30 can be disposed on a position which corresponds to a position of the element base 25 of the fastener element 20.

That is, in the first embodiment, even in a case that the stop claw portion 34*a* of the slider 30 is disposed corresponding to the element base 25, the stop claw portion 34*a* can be engaged securely with the peripheral side surface 44 of the element base 25 and also can hardly be caught in the element base 25 when the stop claw portion 34*a* is lifted up as in the case that the stop claw portion 34*a* is disposed corresponding to the element tip end portion 26.

In the invention, it is possible to use so-called a free slider which does not have any stopping mechanism by the stop claw portion instead of the slider 30 which has the stopping mechanism as described above in order to form a slide fastener.

Further, in the fastener element 20 in the first embodiment, when the cross section orthogonal to the tape width direction of the fastener element 20 is viewed, the peripheral side surface 44 of the first and the second projections 22, 23 obliquely slope such that the element width dimension of the first projection 22 gradually decreases upward and also are formed as a concaved curved surface (concave surface) so as to be concaved toward the element inner side as described above.

Figure 12:
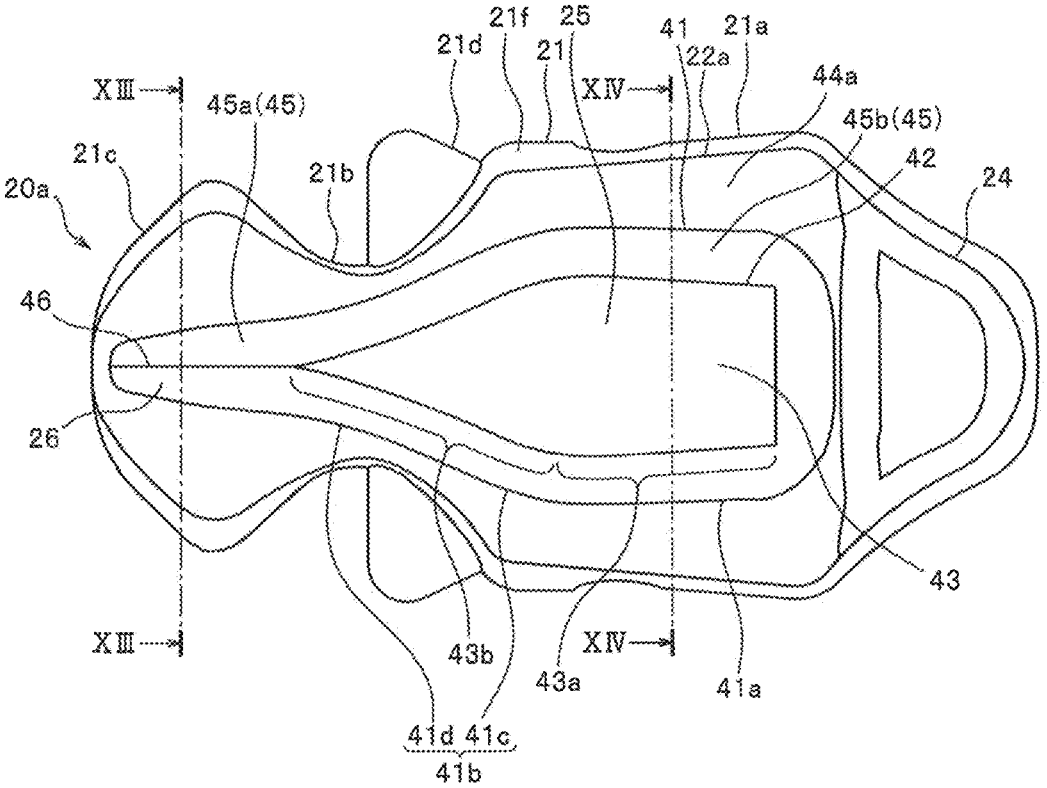
FIG. 12 is a plan view showing a fastener element of a fastener stringer according to a modification of a first embodiment.
Figure 13:
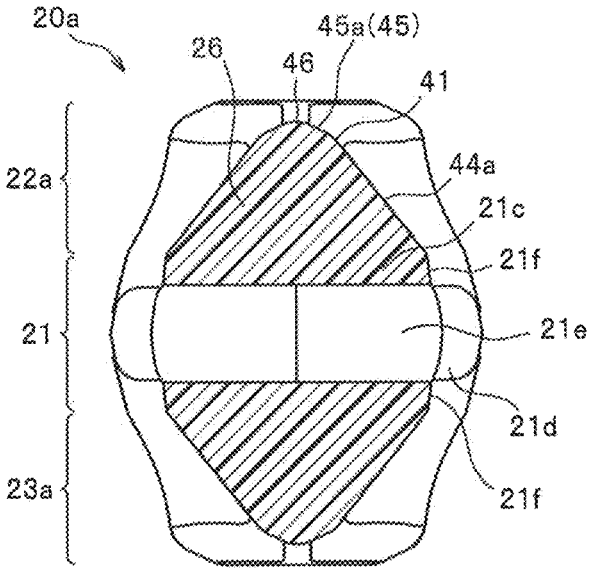
FIG. 13 is an arrow sectional view in XIII-XIII line which is shown in FIG. 12.
Figure 14:
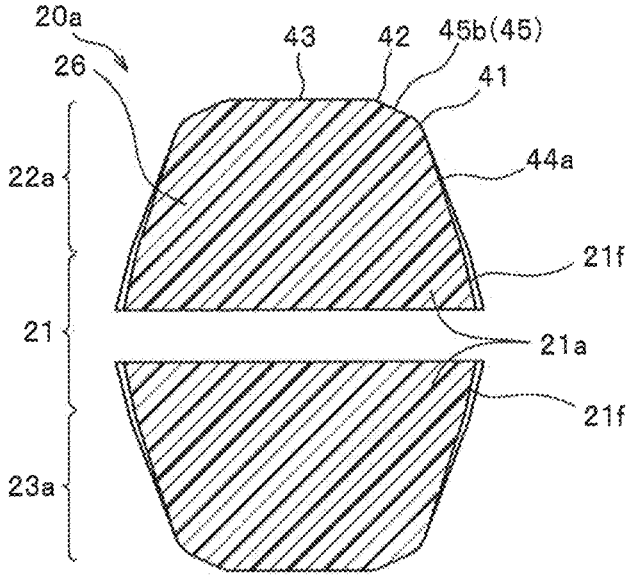
FIG. 14 is an arrow sectional view in XIV-XIV line which is shown in FIG. 12.

However, in the invention, as shown in FIG. 12-FIG. 14 of the fastener element 20*a* according to the modification in the first embodiment, for example, it is also possible that the peripheral side surface 44*a* of the first and the second projections 22*a*, 23*a* is formed as a flat sloped surface which slopes obliquely such that the element width dimension of the first projection 22*a* gradually decreases upward from the element main body portion 21.

Since the peripheral side surface 44*a* of the first and the second projections 22*a*, 23*a* is formed as the flat sloped surface in this manner, an engaging state of the stop claw portion 34*a* of the slider 30 with respect to the peripheral side surface 44*a* may become a bit unstable, compared to the case in the first embodiment as described above. However, when the sliding operation of the slider 30 is started, the stop claw portion 34*a* can be less caught in the first projection 22*a* of the fastener element 20 and the sliding property of the slider 30 can further be improved.

REFERENCE SIGNS LIST

1 Slide fastener
5 First end stop
6 Separable bottom end stop
7 Insert pin
8 Box pin
9 Box
10 Fastener stringer
11 Fastener tape
11*a* Core thread portion
12 Element row
20 Fastener element
20*a* Fastener element
21 Element main body portion
21*a* Body portion
21*b* Neck portion
21*c* Coupling head portion
21*d* Shoulder portion
21*e* Concave groove portion
21*f* Peripheral side surface
22 First projection (Upper projection)
22*a* First projection
23 Second projection (Lower projection)
23*a* Second projection
24 Fin portion
25 Element base
26 Element tip end portion
30 Slider
31 Slider body
31*a* Upper blade
31*b* Guide column
31*c* Attaching column
31*d* Pivot convex portion
31*e* Claw hole
31*f* Flange portion
32 Pull tab
33 Pull tab holding body
34 Stop claw body
34*a* Stop claw portion
35 Plate spring member
36 Slide member
41 First ridge line portion
41*a* Base end region
41*b* Narrow width region
41*c* First narrow width region
41*d* Second narrow width region
42 Second ridge line portion
43 Top surface
43*a* Base end region
43*b* Narrow width region
44 Peripheral side surface
44*a* Peripheral side surface
45 Intermediate sloped surface
45*a* First intermediate sloped surface
45*b* Second intermediate sloped surface
46 Upper end ridge line portion
H1 Maximum height dimension of First projection H2 Maximum height dimension of element main body portion

The invention claimed is:

1. A fastener stringer including a fastener tape and a plurality of fastener elements made of synthetic resin attached to a tape side edge portion of the fastener tape, in which each fastener element includes an element main body portion fixed so as to extend across a first tape surface and a second tape surface of the fastener tape and first and second projections projected in a tape front and back direction from the element main body portion, and in which the element main body portion has a body portion fixed to the fastener tape, a neck portion in a constricted shape extending in a tape outward direction from the body portion and a coupling head portion in an elliptical shape extending from the neck portion, wherein an outer surface of the first projection and an outer surface of the second projection respectively have at least one top surface parallel to the first tape surface and the second tape surface of the fastener tape, a peripheral side surface rising from the element main body portion and at least one sloped surface which is between the top surface and the peripheral side surface and has a different inclination angle with respect to the top surface and the peripheral side surface.

2. The fastener stringer according to claim 1, wherein the first projection includes an element base disposed on the body portion and an element tip end portion extending from the element base in the tape outward direction, wherein the element tip end portion has a tapered shape in which a dimension in a tape length direction gradually decreases toward the tape outward direction, the element base includes a first portion of each of the at least one top surface, the peripheral side surface, and the at least one sloped surface, the element tip end portion includes a second portion of each of the peripheral side surface and the at least one sloped surface, and the second portion of the at least one sloped surface of the element tip end portion of the first projection has an intermediate sloped surface which slopes upward from the peripheral side surface to a top portion so as to have a smaller inclination angle with respect to the first tape surface of the fastener tape than that of the peripheral side surface.

3. The fastener stringer according to claim 2, wherein the intermediate sloped surface of the element tip end portion is formed as a flat surface.

4. The fastener stringer according to claim 2, wherein the peripheral side surface of the element tip end portion is formed as a curved surface which curves in a concave shape or a flat surface from the element main body portion to the intermediate sloped surface.

5. The fastener stringer according to claim 2, wherein the element base includes an intermediate sloped surface which slopes upward from the peripheral side surface to the top surface so as to have a smaller inclination angle with respect to the first tape surface of the fastener tape than that of the peripheral side surface, and the intermediate sloped surface of the element tip end portion and the intermediate sloped surface of the element base are formed as a single continuous surface.

6. The fastener stringer according to claim 5, wherein the intermediate sloped surface of the element tip end portion is disposed so as to extend in the tape outward direction beyond a most constricted part of the neck portion of the element main body portion.

7. The fastener stringer according to claim 5, wherein a first ridge line portion formed between the peripheral side surface and the intermediate sloped surface of the element base is disposed on an outer position than a most constricted part of the neck portion in the tape length direction, and a second ridge line portion formed between the intermediate sloped surface and the top surface of the element base is disposed on an inner position than the most constricted part of the neck portion in the tape length direction.

8. The fastener stringer according to claim 2, wherein a maximum dimension in the tape front and back direction from the element main body portion to the top portion in the element tip end portion of the first projection is set to be larger than a half size of the maximum dimension in the tape front and back direction of the element main body portion.

9. The fastener stringer according to claim 1, wherein the second projection has a plane-symmetrical shape with respect to the first projection about a center position in the tape front and back direction of the fastener tape.

* * * * *